US008991310B2

(12) United States Patent
Stowe et al.

(10) Patent No.: US 8,991,310 B2
(45) Date of Patent: Mar. 31, 2015

(54) SYSTEM FOR DIRECT APPLICATION OF DAMPENING FLUID FOR A VARIABLE DATA LITHOGRAPHIC APPARATUS

(75) Inventors: Timothy Stowe, Alameda, CA (US); David Biegelsen, Portola Valley, CA (US); Lars Erik Swartz, Sunnyvale, CA (US); Jurgen Daniel, San Francisco, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 824 days.

(21) Appl. No.: 13/204,548

(22) Filed: Aug. 5, 2011

(65) Prior Publication Data

US 2013/0033688 A1 Feb. 7, 2013

(51) Int. Cl.

| | |
|---|---|
| ***B41L 17/00*** | (2006.01) |
| ***B41F 7/00*** | (2006.01) |
| ***B41F 7/30*** | (2006.01) |
| ***B41C 1/10*** | (2006.01) |

(Continued)

(52) U.S. Cl.

CPC ..... *B41F 7/30* (2013.01); *B41C 1/1033* (2013.01); *B41F 7/32* (2013.01); *B41F 7/34* (2013.01); *B41P 2227/70* (2013.01)

USPC ..... 101/147; 101/450.1

(58) Field of Classification Search

CPC ..... B41C 1/00; B41C 1/10; B41C 1/1033; B41C 1/1008; B41M 1/06; B41M 9/00; B41N 3/08; B41N 3/00

USPC ..... 101/401.1, 141, 147, 450.1, 451, 452

See application file for complete search history.

(56) References Cited

U.S. PATENT DOCUMENTS

| | | | |
|---|---|---|---|
| 3,656,200 | A | 4/1972 | Riley, Jr. |
| 3,677,329 | A | 7/1972 | Kirkpatrick |

(Continued)

FOREIGN PATENT DOCUMENTS

| | | | |
|---|---|---|---|
| CH | 277540 | | 8/1951 |
| DE | 3108541 | A1 | 11/1982 |

(Continued)

OTHER PUBLICATIONS

U.S. Appl. No. 13/095,714, Apr. 27, 2011, Stowe et al.

(Continued)

*Primary Examiner* — Daniel J Colilla
*Assistant Examiner* — John M Royston
(74) *Attorney, Agent, or Firm* — Bever, Hoffman & Harms, LLP

(57) ABSTRACT

A system and corresponding methods are disclosed for applying a dampening fluid to a reimageable surface of an imaging member in a variable data lithography system, without a form roller. In one embodiment, the system includes subsystems for converting a dampening fluid from a liquid phase to a dispersed fluid phase, and for directing flow of a dispersed fluid comprising the dampening fluid in dispersed fluid phase to the reimageable surface. The dampening fluid reverts to the liquid phase directly on the reimageable surface. In another embodiment a continuous ribbon of dampening fluid may be applied directly to the reimageable surface. This embodiment includes a body structure having a port for delivering dampening fluid in a continuous fluid ribbon directly to the reimageable surface, and a mechanism, associated with the body structure, for stripping an entrained air layer over the reimageable surface when the reimageable surface is in motion.

12 Claims, 12 Drawing Sheets

(51) Int. Cl.
*B41F 7/32* (2006.01)
*B41F 7/34* (2006.01)

(56) References Cited

U.S. PATENT DOCUMENTS

| | | | | |
|---|---|---|---|---|
| 3,741,118 | A | 6/1973 | Carley | |
| 3,800,699 | A | 4/1974 | Carley | |
| 3,871,081 | A | 3/1975 | Inoue et al. | |
| 3,877,372 | A | 4/1975 | Leeds | |
| 4,395,113 | A | 7/1983 | Buchan et al. | |
| 4,439,035 | A | 3/1984 | Landa | |
| 4,627,349 | A | 12/1986 | Claussen | |
| 4,729,310 | A * | 3/1988 | Love, III | 101/157 |
| 4,811,661 | A | 3/1989 | Maruta | |
| 4,887,528 | A | 12/1989 | Ruge | |
| 4,890,135 | A | 12/1989 | Gardiner et al. | |
| 5,067,404 | A | 11/1991 | Frunder et al. | |
| 5,218,905 | A | 6/1993 | Bolte et al. | |
| 5,365,849 | A | 11/1994 | Spiegel | |
| 5,701,815 | A | 12/1997 | Bocko | |
| 5,855,173 | A | 1/1999 | Chatterjee et al. | |
| 5,954,911 | A | 9/1999 | Bergman et al. | |
| 6,029,577 | A | 2/2000 | Fukuoka et al. | |
| 6,125,756 | A | 10/2000 | Nussel et al. | |
| 6,146,798 | A | 11/2000 | Bringans et al. | |
| 6,152,032 | A | 11/2000 | Belanger et al. | |
| 6,298,780 | B1 | 10/2001 | Ben-Horin et al. | |
| 6,318,264 | B1 | 11/2001 | D'Heureuse et al. | |
| 6,458,507 | B1 | 10/2002 | Burberry et al. | |
| 6,561,090 | B1 | 5/2003 | Spooner | |
| 6,725,777 | B2 | 4/2004 | Katano | |
| 6,796,227 | B1 * | 9/2004 | Miller | 101/147 |
| 6,841,366 | B1 | 1/2005 | Bower et al. | |
| 6,901,853 | B2 | 6/2005 | Baldy et al. | |
| 7,020,355 | B2 | 3/2006 | Lahann et al. | |
| 7,061,513 | B2 | 6/2006 | Katano et al. | |
| 7,100,503 | B2 | 9/2006 | Wiedemer et al. | |
| 7,191,705 | B2 * | 3/2007 | Berg et al. | 101/465 |
| 7,421,948 | B2 | 9/2008 | Schneider et al. | |
| 7,717,039 | B2 | 5/2010 | Becker et al. | |
| 2003/0167950 | A1 | 9/2003 | Mori | |
| 2004/0011234 | A1 | 1/2004 | Figov | |
| 2005/0028698 | A1 | 2/2005 | Mori et al. | |
| 2005/0175833 | A1 | 8/2005 | Yoneda | |
| 2005/0178281 | A1 | 8/2005 | Berg et al. | |
| 2005/0258136 | A1 | 11/2005 | Kawanishi | |
| 2006/0152566 | A1 | 7/2006 | Taniuchi | |
| 2006/0243162 | A1 | 11/2006 | Hanneman, Jr. et al. | |
| 2007/0199457 | A1 | 8/2007 | Cyman, Jr. et al. | |
| 2007/0199458 | A1 | 8/2007 | Cyman, Jr. et al. | |
| 2007/0199459 | A1 | 8/2007 | Cyman, Jr. et al. | |
| 2007/0199460 | A1 | 8/2007 | Cyman, Jr. et al. | |
| 2007/0199461 | A1 | 8/2007 | Cyman, Jr. et al. | |
| 2007/0199462 | A1 | 8/2007 | Cyman, Jr. et al. | |
| 2008/0011177 | A1 | 1/2008 | Muraoka | |
| 2008/0032072 | A1 | 2/2008 | Taniuchi | |
| 2008/0202368 | A1 | 8/2008 | Kajitani et al. | |
| 2008/0223240 | A1 | 9/2008 | Drury | |
| 2009/0282995 | A1 * | 11/2009 | Kosciesza | 101/147 |
| 2010/0031838 | A1 | 2/2010 | Lewis et al. | |
| 2010/0251914 | A1 | 10/2010 | Zhou et al. | |

FOREIGN PATENT DOCUMENTS

| | | | |
|---|---|---|---|
| DE | 2629708 | A1 | 7/1997 |
| DE | 101 60 734 | A1 | 7/2002 |
| DE | 10202785 | A1 | 7/2003 |
| DE | 103 60 108 | A1 | 7/2004 |
| DE | 10 2006 050744 | A1 | 4/2008 |
| DE | 10 2008 062741 | | 7/2010 |
| EP | 1 935 640 | A2 | 6/2008 |
| EP | 1 938 987 | A2 | 7/2008 |
| EP | 1 964 678 | A2 | 9/2008 |
| EP | 12178611.5 | | 10/2012 |
| GB | GP 714326 | | 8/1954 |
| GB | 719 239 | A | 12/1954 |
| JP | 60 147339 | A | 8/1985 |
| WO | WO 03/070466 | A1 | 8/2003 |
| WO | 2006/133024 | A2 | 12/2006 |
| WO | WO 2009025821 | A1 | 2/2009 |

OTHER PUBLICATIONS

U.S. Appl. No. 13/095,737, Apr. 27, 2011, Stowe et al.
U.S. Appl. No. 13/095,745, Apr. 27, 2011, Stowe et al.
U.S. Appl. No. 13/095,757, Apr. 27, 2011, Stowe et al.
U.S. Appl. No. 13/095,764, Apr. 27, 2011, Stowe et al.
U.S. Appl. No. 13/095,773, Apr. 27, 2011, Stowe et al.
U.S. Appl. No. 13/095,778, Apr. 27, 2011, Stowe et al.
U.S. Appl. No. 13/204,515, Aug. 5, 2011, Stowe et al.
U.S. Appl. No. 13/204,526, Aug. 5, 2011, Stowe et al.
U.S. Appl. No. 13/204,560, Aug. 5, 2011, Pattekar et al.
U.S. Appl. No. 13/204,567, Aug. 5, 2011, Stowe et al.
U.S. Appl. No. 13/204,578, Aug. 5, 2011, Stowe et al.
U.S. Appl. No. 13/366,947, Feb. 6, 2012, Biegelsen.
U.S. Appl. No. 13/426,209, Mar. 21, 2012, Liu et al.
U.S. Appl. No. 13/426,262, Mar. 21, 2012, Liu et al.
Shen et al., "A new understanding on the mechanism of fountain solution in the prevention of ink transfer to the non-image area in conventional offset lithography", J. Adhesion Sci. Technol., vol. 18, No. 15-16, pp. 1861-1887 (2004).
Katano et al., "The New Printing System Using the Materials of Reversible Change of Wettability", International Congress of Imaging Science 2002, Tokyo, pp. 297 et seq. (2002).
Kjelgaard, M., "Humidification Side by Side", Engineered Systems Mag., (Troy, MI 2002).
Turpin, Joanna, "Ultrasonic Humidification is Ultra-Efficient", Engineered SYstems Mag., (Troy, MI 2003).
CABOT, CAB-O-JET 200 Technical Data Sheet, Published Feb. 2009, 1 page.
EP Search Report for corresponding EP Application No. 12178609.9 filed Jul. 31, 2012, now EP Patent No. 2554383 (6 pages).
EP Search Report for corresponding EP Application No. 12178608.1 filed Jul. 31, 2012, now EP Patent No. 2554382 (2 pages).

* cited by examiner

SYSTEM FOR DIRECT APPLICATION OF DAMPENING FLUID FOR A VARIABLE DATA LITHOGRAPHIC APPARATUS

CROSS-REFERENCE TO RELATED APPLICATIONS

The present disclosure is related to U.S. patent application titled "Variable Data Lithographic System", Ser. No. 13/095,714, filed on Apr. 27, 2011, and assigned to the same assignee as the present application, and further which is incorporated herein by reference.

BACKGROUND

The present disclosure is related to marking and printing methods and systems, and more specifically to methods and systems for deposition of a dampening fluid directly onto the imaging member, without an intermediate member such as a form roller.

Offset lithography is a common method of printing today. (For the purposes hereof, the terms "printing" and "marking" are interchangeable.) In a typical lithographic process a printing plate, which may be a flat plate, the surface of a cylinder, or belt, etc., is formed to have "image regions" formed of hydrophobic and oleophilic material, and "non-image regions" formed of a hydrophilic material. The image regions are regions corresponding to the areas on the final print (i.e., the target substrate) that are occupied by a printing or marking material such as ink, whereas the non-image regions are the regions corresponding to the areas on the final print that are not occupied by said marking material. The hydrophilic regions accept and are readily wetted by a water-based fluid, commonly referred to as a dampening fluid or fountain fluid (typically consisting of water and a small amount of alcohol as well as other additives and/or surfactants to reduce surface tension). The hydrophobic regions repel dampening fluid and accept ink, whereas the dampening fluid formed over the hydrophilic regions forms a fluid "release layer" for rejecting ink. Therefore the hydrophilic regions of the printing plate correspond to unprinted areas, or "non-image areas", of the final print.

The ink may be transferred directly to a substrate, such as paper, or may be applied to an intermediate surface, such as an offset (or blanket) cylinder in an offset printing system. The offset cylinder is covered with a conformable coating or sleeve with a surface that can conform to the texture of the substrate, which may have surface peak-to-valley depth somewhat greater than the surface peak-to-valley depth of the imaging plate. Also, the surface roughness of the offset blanket cylinder helps to deliver a more uniform layer of printing material to the substrate free of defects such as mottle. Sufficient pressure is used to transfer the image from the offset cylinder to the substrate. Pinching the substrate between the offset cylinder and an impression cylinder provides this pressure.

Typical lithographic and offset printing techniques utilize plates which are permanently patterned, and are therefore useful only when printing a large number of copies of the same image (long print runs), such as magazines, newspapers, and the like. However, they do not permit creating and printing a new pattern from one page to the next without removing and replacing the print cylinder and/or the imaging plate (i.e., the technique cannot accommodate true high speed variable data printing wherein the image changes from impression to impression, for example, as in the case of digital printing systems). Furthermore, the cost of the permanently patterned imaging plates or cylinders is amortized over the number of copies. The cost per printed copy is therefore higher for shorter print runs of the same image than for longer print runs of the same image, as opposed to prints from digital printing systems.

Accordingly, a lithographic technique, referred to as variable data lithography, has been developed which uses a non-patterned reimageable surface coated with dampening fluid. Regions of the dampening fluid are removed by exposure to a focused radiation source (e.g., a laser light source). A temporary pattern in the dampening fluid is thereby formed over the non-patterned reimageable surface. Ink applied thereover is retained in pockets formed by the removal of the dampening fluid. The inked surface is then brought into contact with a substrate, and the ink transfers from the pockets in the dampening fluid layer to the substrate. The dampening fluid may then be removed, a new, uniform layer of dampening fluid applied to the reimageable surface, and the process repeated.

In the aforementioned system it is very important to have an initial layer of dampening fluid that is of a uniform and desired thickness. To accomplish this, a form roller nip wetting system, which comprises a roller fed by a solution supply, is brought proximate the reimageable surface. Dampening fluid is then transferred from the form roller to the reimageable surface. However, such a system relies on the mechanical integrity of the form roller and the reimageable surface to obtain a uniform layer. Mechanical alignment errors, positional and rotational tolerances, and component wear each contribute to variation in the roller-surface spacing, resulting in deviation of the dampening fluid thickness from ideal.

Furthermore, an artifact known as ribbing instability in the roll-coating process leads to a non-uniform dampening solution layer thickness. This variable thickness manifests as streaks or continuous lines in a printed image.

Still further, while great efforts are taken to clean the roller after each printing pass, in some systems it is inevitable that contaminants (such as ink from prior passes) remain on the reimageable surface when a layer of dampening fluid is applied. The remaining contaminants can attach themselves to the form roller that deposits the dampening fluid. The roller may thereafter introduce image artifacts from the contaminants into subsequent prints, resulting in an unacceptable final print.

In addition, cavitation may occur on the form roller in the transfer nip due to Taylor Instabilities (see, e.g., "An Outline of Rheology in Printing" by W. H. Banks, in the journal Rheologica Acta, pp. 272-275 (1965)). To avoid these instabilities, systems have been designed with multiple rollers that move back and forth in the axial direction while also moving in rolling contact with the form roller, to break up the rib and streak formation. However, this roller mechanism adds delay in the "steadying out" of the dampening system so printing cannot start until the dampening fluid layer thickness has stabilized on all the roller surfaces. Also, on-the-fly dampening fluid flow control is not possible since the dampening fluid layer is at that point already built up on the form roller and the other dampening system rollers acts as a buffering mechanism.

Accordingly, efforts have been made to develop systems to deposit dampening fluid directly on the offset plate surface as opposed to on intermediate rollers or a form roller. One such system applies the dampening fluid onto the reimageable offset plate surface. See, e.g., U.S. Pat. No. 6,901,853 and U.S. Pat. No. 6,561,090. However, due to the fact that these dampening systems are used with conventional (pre-patterned) offset plates, the mechanism of transfer of the dampening fluid to the offset plate includes a 'forming roller' that is in rolling contact with the offset plate cylinder to transfer the FS to the plate surface in a pattern-wise fashion—since it is the nip action of contact rolling between the form roller and the patterned offset plate surface that squeezes out the fountain solution from the hydrophobic regions of the offset plate, allowing the subsequent ink transfer selectivity mechanism to work as desired.

While the spray dampening system provides the advantage of precisely metering out the desired flow rate of the dampening fluid through control of the spray system, as well as the ability to manipulate the dampening fluid layer thickness on-the-fly as needed, the requirement of using the dampening system form roller as the final means of transferring the dampening fluid to the plate surface reintroduces the disadvantages of thickness variation, roller contamination, roller cavitation, and so on.

SUMMARY

Accordingly, the present disclosure is directed to systems and methods providing a dampening fluid directly to a reimageable surface of a variable data lithographic system that does not employ a dampening form roller. Systems and methods are disclosed for application of dampening fluid directly to a reimageable surface of an imaging member in such a system.

A system and corresponding methods are disclosed herein for applying a dampening fluid to a reimageable surface of an imaging member in a variable data lithography system, comprising a subsystem for converting a dampening fluid from a liquid phase to a fine droplet or vapor state (herein referred to as a dispersed fluid), a subsystem for directing flow of said dispersed fluid comprising the dampening fluid in droplet or vapor phase to the reimageable surface, whereby the dampening fluid reverts to a continuous liquid layer directly on, and is thereby deposited on, the reimageable surface to form a dampening fluid layer.

A number of alternative systems and methods may be used for converting the liquid dampening fluid to a dispersed fluid, such as: an ultrasonic-based subsystem, a nozzle-based nebulizer subsystem, an impeller-based subsystem, and a vapor chamber subsystem. A bias or ionic charging subsystem may optionally be provided for applying a charge to droplets of dampening fluid while the dampening fluid is in a dispersed fluid state, to thereby enable the droplets to repel each other and avoid recombination prior to deposition on the reimageable surface and to enhance deposition onto the reimageable surface.

Various feedback and control systems are provided to measure the thickness of the layer of dampening fluid applied to the reimageable surface, and control, dynamically or otherwise, aspects of the dampening fluid deposition process to obtain and maintain a desired layer thickness.

In an alternative dampening fluid deposition system and method, a continuous ribbon of dampening fluid may be applied directly to the reimageable surface. According to this alternative, a subsystem for applying a dampening fluid to a reimageable surface comprises: a body structure having formed therein a port, the port extending in a first direction substantially perpendicular to a direction of travel of the reimageable surface when in use, the port having a width at least equal to a width of the reimageable surface in the first direction, the port configured to deliver dampening fluid in a continuous fluid ribbon directly to the reimageable surface to thereby form a dampening fluid layer thereover; a mechanism, associated with the body structure, for disrupting an entrained air layer over the reimageable surface when the reimageable surface is in motion; a dampening fluid reservoir disposed to provide dampening fluid to the port; and a control mechanism for controlling the flow of dampening fluid from the reservoir to the port and from the port to the reimageable surface. The mechanism may be a vortex-generating surface formed in the body structure. The control mechanism may be a valve, and may form a part of a thickness sensor control mechanism.

The above is a summary of a number of the unique aspects, features, and advantages of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that description of well-known starting materials, processing techniques, components, equipment, and other well-known details are merely summarized or are omitted so as not to unnecessarily obscure the details of the present invention. Thus, where details are otherwise well known, we leave it to the application of the present invention to suggest or dictate choices relating to those details.

Figure 1:
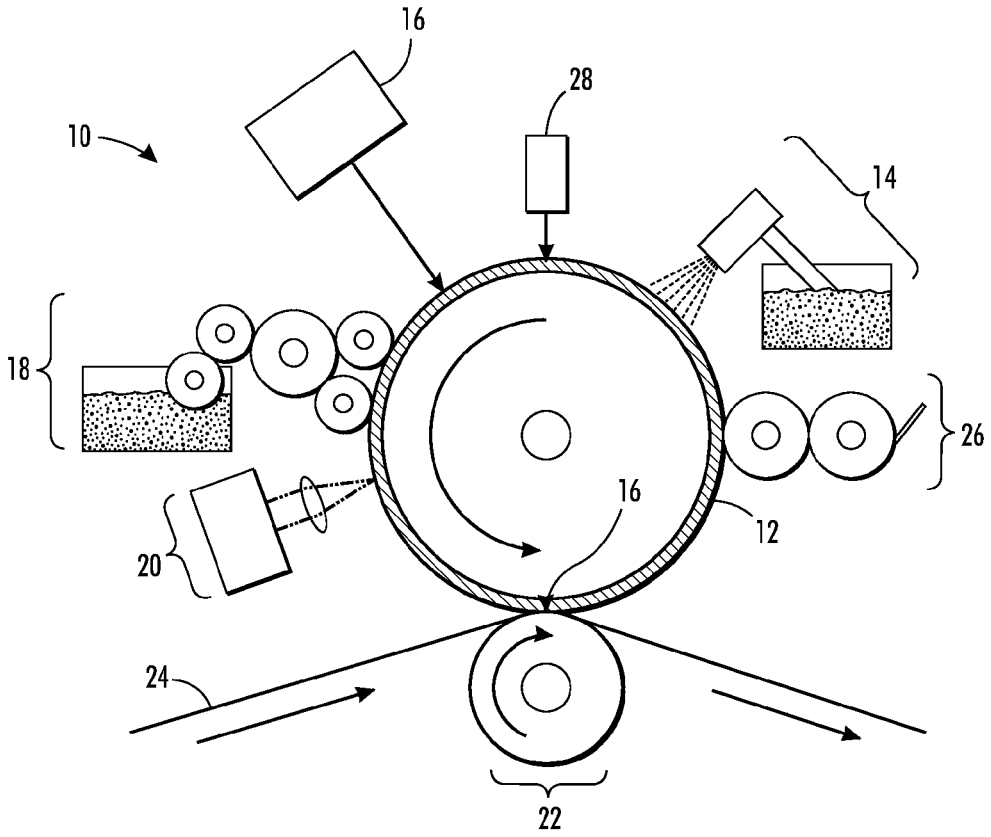
FIG. 1 is a side view of a system for variable lithography including a non-contact dampening fluid deposition subsystem according to an embodiment of the present disclosure.

With reference to FIG. 1, there is shown therein a system 10 for variable data lithography according to one embodiment of the present disclosure. System 10 comprises an imaging member 12, in this embodiment a drum, but may equivalently be a plate, belt, etc., surrounded by a no-roller, direct-application dampening fluid subsystem 14, an optical patterning subsystem 16, an inking subsystem 18, a rheology (complex viscoelastic modulus) control subsystem 20, transfer subsystem 22 for transferring an inked image from the surface of imaging member 12 to a substrate 24, and finally a surface cleaning subsystem 26. Many optional subsystems may also be employed, such as a dampening fluid thickness sensor subsystem 28. Other such subsystems are beyond the scope of the present disclosure. With the exception of the specifics of dampening fluid subsystem 14, each of these subsystems, as well as operation of the system as a whole, are described in further detail in the aforementioned U.S. patent application Ser. No. 13/095,714.

The key requirement of dampening fluid subsystem 14 is to deliver a layer of dampening fluid having a uniform and controllable thickness over a reimageable surface layer over imaging member 12. In one embodiment this layer is in the range of 0.2 μm to 1.0 μm, and very uniform without pinholes. The dampening fluid must have the property that it wets and thus tends to spread out on contact with the reimageable surface. Depending on the surface free energy of the reimageable surface the dampening fluid itself may be composed mainly of water, optionally with small amounts of isopropyl alcohol or ethanol added to reduce its natural surface tension as well as lower the evaporation energy necessary for subsequent laser patterning. In addition, a suitable surfactant may be added in a small percentage by weight, which promotes a high amount of wetting to the reimageable surface layer. In one embodiment, this surfactant consists of silicone glycol copolymer families such as trisiloxane copolyol or dimethicone copolyol compounds which readily promote even spreading and surface tensions below 22 dynes/cm at a small percentage addition by weight. Other fluorosurfactants are also possible surface tension reducers. Optionally the dampening fluid may contain a radiation sensitive dye to partially absorb laser energy in the process of patterning. Optionally the dampening fluid may be non-aqueous consisting of, for example, polyfluorinated ether or fluorinated silicone fluid.

In the description of embodiments of a dampening fluid subsystem 14 that follow it will be appreciated that as there is no pre-formed hydrophilic-hydrophobic pattern on a printing plate in system 10, the need for a form roller to transfer the dampening fluid is obviated. As mentioned, a laser (or other radiation source) is used to form pockets in, and hence pattern, the dampening fluid. The characteristics of the pockets (such as depth and cross-sectional shape), which determine the quality of the ultimate printed image, are in large part a function of the effect that the laser has on the dampening fluid. This effect is to a large degree controlled by the thickness of the dampening fluid at the point of incidence of the laser. Therefore, to obtain a controlled and preferred pocket shape, it is important to control and make uniform the thickness of the dampening fluid layer, and to do so without introducing unwanted artifacts into the printed image.

Ultrasonic Spray Subsystem

Figure 2:
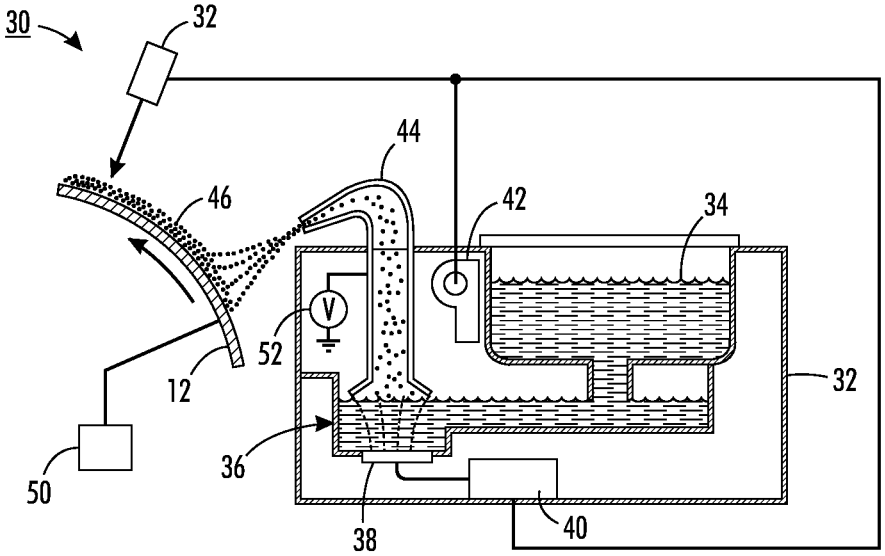
FIG. 2 is a cross-sectional view of a first embodiment of an ultrasonic spray subsystem comprising a portion of a non-contact dampening fluid deposition subsystem according to the present disclosure.

Accordingly, with reference to FIG. 2, there is shown therein a dampening fluid subsystem 30 according to a first embodiment of the present disclosure, which forms and delivers a vapor, or mist, of dampening fluid to the reimageable surface layer of imaging member 12. Dampening fluid subsystem 30 comprises housing 32 in which a reservoir 34 of dampening fluid is maintained. Reservoir 34 feeds a dispersed fluid generation region 36. An ultrasonic transducer 38, under control of controller 40, ejects fine droplets of dampening fluid to form a dispersed fluid. The dispersed fluid, which may further include a delivery fluid (typically air), is transported by way of a positive internal pressure from pressurization means 42 to and ultimately out of a nozzle 44. The output of nozzle 44 is directed toward the reimageable surface layer of imaging member 12, thereby depositing a layer of droplets which spread out to form a continuous layer 46 of dampening fluid thereover.

Many ultrasonic humidifier devices are known in the art, and such devices may be modified based on the present disclosure to perform the function described herein. A commercially available system on which such a system may be based is the KAZ 5520 ultrasonic humidifier manufactured by Honeywell. Other examples include the BNB and BNU Series Stulz-Ultrasonic™ Humidifier, by Stulz Air Technology Systems, Inc. Therefore, the specific embodiment shown in FIG. 2 is merely by way of example, and shall not otherwise limit the scope of the present disclosure.

Figure 3:
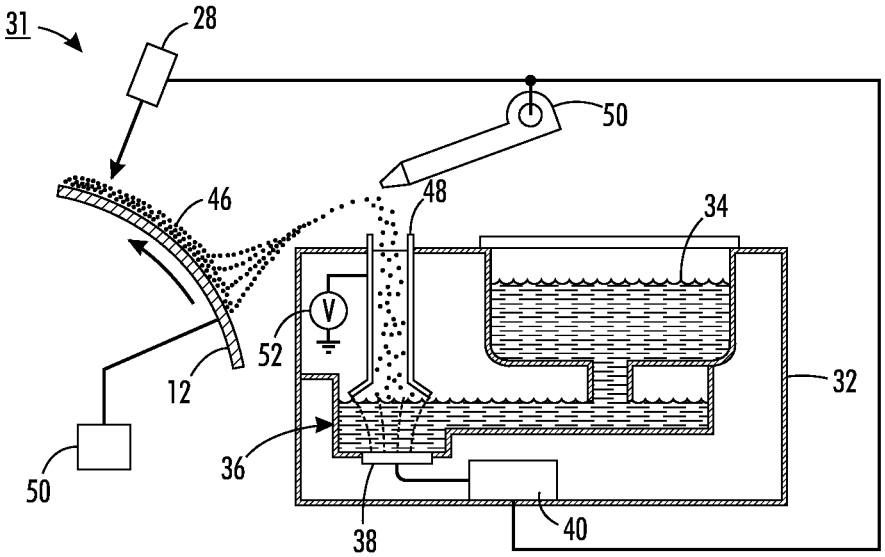
FIG. 3 is a cross-sectional view of a second embodiment of an ultrasonic spray subsystem comprising a portion of a non-contact dampening fluid deposition subsystem according to the present disclosure.

In an alternative embodiment 31, shown in FIG. 3, essentially the same ultrasonic device generates a dispersed fluid of dampening fluid, but rather than being transported by way of internal positive pressure and a directed nozzle, the vapor of dampening fluid is carried from a nozzle 48 by way of a directed carrier stream (e.g., of air) generated using an air knife 50 to the reimageable surface layer of imaging member 12. By controlling both the amplitude and frequency of the vibrating ultrasonic transducer 38 and also the flow rate of the air knife, one can manipulate the exact amount of dampening fluid that is deposited onto the reimageable surface layer of imaging member 12. The pressure of air knife 50 is manipulated to control the airflow rate for depositing the dampening fluid at the desired rate. A control subsystem incorporating thickness sensor subsystem 28 may accomplish this dampening fluid deposition control.

In certain embodiments steps may be taken to ensure that the generated droplets do not re-combine in mid-air, so that a controlled layer of dampening fluid can be formed on the reimageable surface layer of imaging member 12. One method of achieving this objective is to electrically charge the droplets, to enable the droplets to repel each other and avoid recombination prior to deposition on the reimageable surface. This may be accomplished, for example, by a bias system 52, which applies a bias to nozzle 44 (FIG. 2) or nozzle 48 (FIG. 3). Furthermore, by placing opposite charge uniformly on the reimageable surface of imaging member 12, using for example a scorotron, 50-, upstream of the dispersed fluid deposition region, the oppositely charged droplets can be attracted to the surface to neutralize the charge and form a uniform layer.

Nozzle-Based Nebulizer Spray Subsystem

Figure 4:
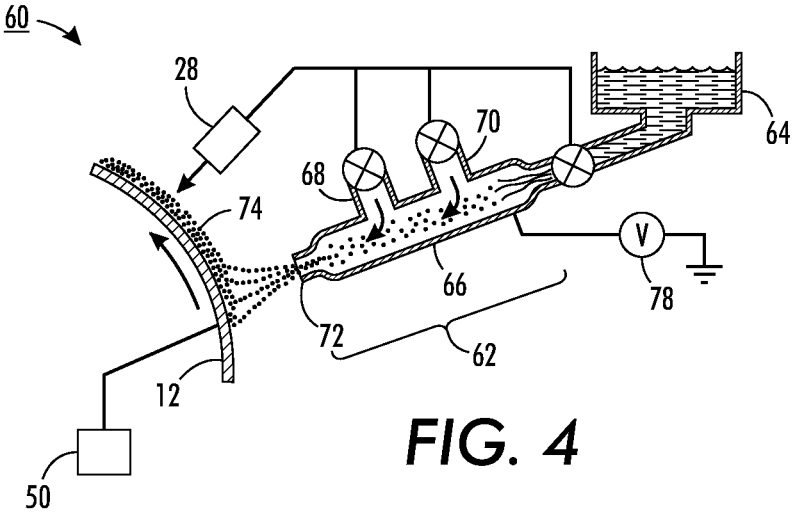
FIG. 4 is a cross-sectional view of a first embodiment of a nebulizer-based spray subsystem comprising a portion of a non-contact dampening fluid deposition subsystem according to the present disclosure.

Referring next to FIG. 4, according to another embodiment 60, a nebulizer assembly 62 is utilized to generate the fine droplets of the dampening fluid. While there are many different arrangements of nebulizers, in one example dampening fluid from reservoir 64 is introduced into one end of a tee-structure 66 in which one or more ports 68, 70 introduce a carrier, such as air. In one embodiment, one port 68 may introduce the carrier at an elevated temperature as compared to the carrier temperature in second port 70. The relative pressure within tee-structure 66, and if present the temperature differential between the introduced carriers, result in creating a dispersed fluid of the dampening fluid and carrier within tee-structure 66. A narrow exit port (nozzle) 72 is provided in an end of tee-structure 66 through which the dispersed dampening fluid is ejected onto the reimageable surface layer of imaging member 12.

Control over the carrier flow rates, carrier temperatures, and rate of dampening fluid introduction into tee-structure 66 provide control over the thickness of the layer 74 of dampening fluid deposited onto the reimageable surface layer of imaging member 12. A control subsystem incorporating thickness sensor subsystem 28 may accomplish this dampening fluid deposition control.

Figure 5:
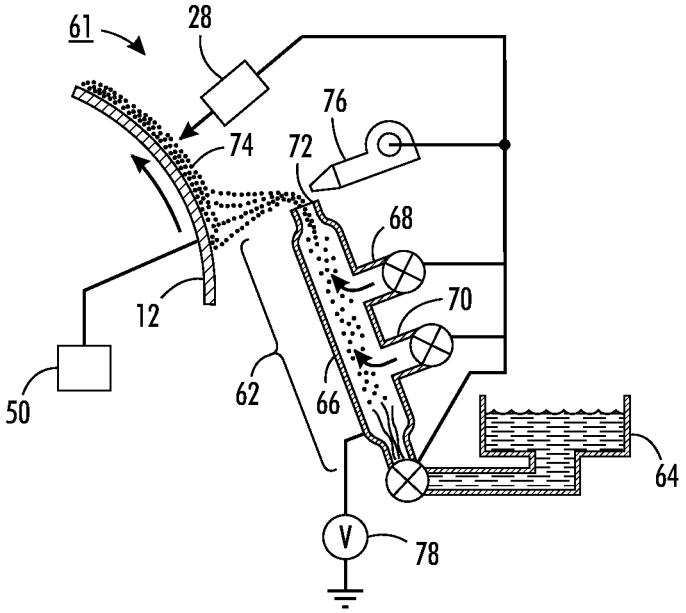
FIG. 5 is a cross-sectional view of a second embodiment of a nebulizer-based spray subsystem comprising a portion of a non-contact dampening fluid deposition subsystem according to the present disclosure.

In an alternative embodiment 61, shown in FIG. 5, the dispersed fluid created using nebulizer assembly 62 is directed to the reimageable surface layer of imaging member 12 through the use of a directed carrier stream (e.g., of air) generated using an air knife 76. By controlling the carrier flow rates, carrier temperatures, rate of dampening fluid introduction into tee-structure 66, and the flow rate of the air knife, control over the thickness of the layer 74 of dampening fluid deposited onto the reimageable surface layer of imaging member 12 may be provided. A control subsystem incorporating thickness sensor subsystem 28 may accomplish this dampening fluid deposition control.

In certain embodiments steps may be taken to ensure that the generated droplets do not re-combine in mid-air, so that a controlled layer of dampening fluid can be formed on the reimageable surface layer of imaging member 12. One method of achieving this objective is to electrically charge the droplets exiting at nozzle 72, to enable the droplets to repel each other and avoid recombination prior to deposition on to the reimageable surface. This may be accomplished, for example, by a bias system 78, which applies a bias to nozzle 72, as shown in each of FIGS. 4 and 5.

Impeller-Based Spray Subsystem

Figure 6:
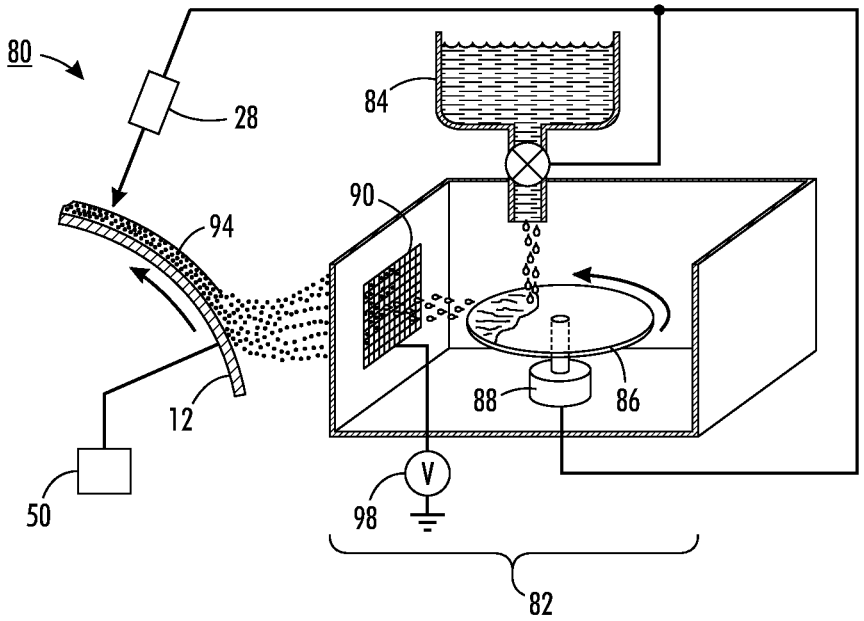
FIG. 6 is a cross-sectional view of a first embodiment of an impeller-based spray subsystem comprising a portion of a non-contact dampening fluid deposition subsystem according to the present disclosure.

Referring next to FIG. 6, according to another embodiment 80, an impeller-based subsystem 82 is used. There are many different arrangements of impeller systems, such as impeller ejection systems, impeller-humidifiers, and the like, which may provide the functionality described herein. Therefore, while one specific embodiment is described in order to illustrate the desired functionality, it will be understood that alternate systems may equivalently be used.

In the exemplary subsystem 82, dampening fluid from reservoir 84 is introduced onto a disk or impeller 86, which is caused to rotate by motor 88. The dampening fluid briefly accumulates on impeller 86, but due to the centrifugal force induced by the rotation of impeller 86, droplets of the dampening fluid are accelerated in a direction away from the center of impeller 86 toward a diffuser 90 comprised of a mesh, screen, comb filter, etc. The droplets of the dampening fluid hit diffuser 90 at a relatively high velocity, and are thereby broken up into even finer droplets. Temperature of the fluid, impeller 86, and/or diffuser 90 may be controlled to enhance vapor production. A commercially available system that may form the basis for such an embodiment is the KAZ V400 impeller humidifier, manufactured by Honeywell. The vapor of dampening fluid is directed onto the reimageable surface layer of imaging member 12, where it accumulates as a layer 94 of dampening fluid.

Figure 7:
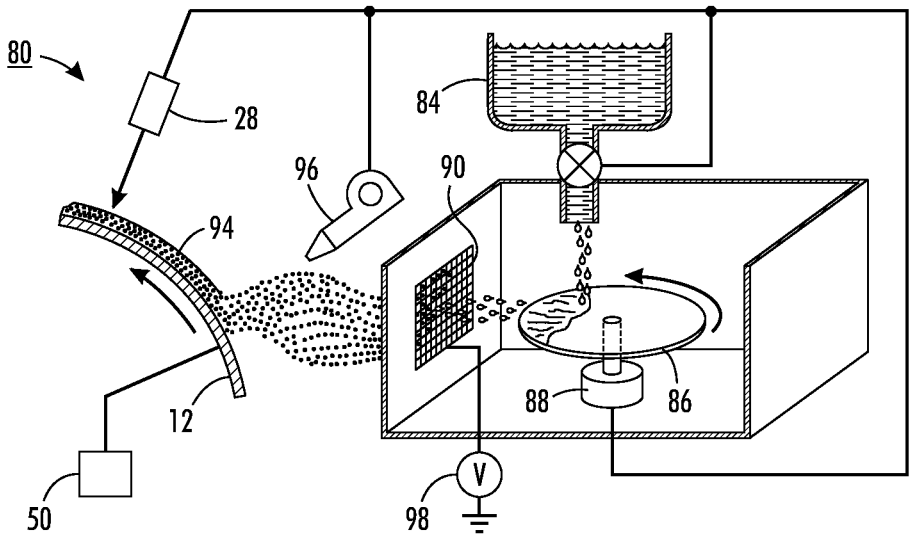
FIG. 7 is a cross-sectional view of a second embodiment of an impeller-based spray subsystem comprising a portion of a non-contact dampening fluid deposition subsystem according to the present disclosure.

In an alternative embodiment 81, shown in FIG. 7, the dispersed fluid created using impeller subsystem 82 is directed to the reimageable surface layer of imaging member 12 through the use of a directed carrier stream (e.g., of air) generated using an air knife 96. By controlling the rate of deposit of dampening fluid onto impeller 86, the rotation velocity of impeller 86, the geometry of diffuser 90, and the flow rate of air knife 96, control over the thickness of the layer 94 of dampening fluid deposited onto the reimageable surface layer of imaging member 12 may be provided. A control subsystem incorporating thickness sensor subsystem 28 may accomplish this dampening fluid deposition control.

In certain embodiments steps may be taken to ensure that the generated droplets do not re-combine in mid-air, so that a controlled layer of dampening fluid can be formed on the reimageable surface layer of imaging member 12. One method of achieving this objective is to electrically charge the droplets exiting at diffuser 90, to enable the droplets to repel each other and avoid recombination prior to deposition on to the reimageable surface. This may be accomplished, for example, by a bias system 98, which applies a bias to diffuser 90, as shown in each of FIGS. 6 and 7.

Figure 8:
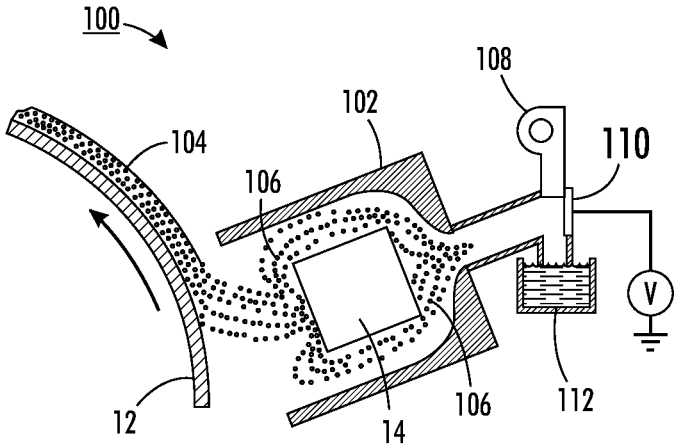
FIG. 8 is a cross-sectional view of a first embodiment of a dampening fluid vapor removal subsystem comprising a portion of a non-contact dampening fluid deposition subsystem according to the present disclosure.

In each of the aforementioned embodiments there may be a desire to remove dampening fluid introduced into the environment but not deposited onto the reimageable surface layer of imaging member 12, referred to herein as overspray. Motivations to do so include reducing waste, ensuring that unsafe additives to the dampening fluid are not vented into the environment, etc. According to one embodiment 100 for capturing overspray illustrated in FIG. 8, dampening fluid subsystem 14 is housed in a containment structure 102.

Containment structure 102 is sized and positioned such that a substantial amount of generated dispersed fluid is introduced proximate the reimageable surface layer of imaging member 12. A portion 104 of the dispersed fluid is deposited onto the reimageable surface, which is carried clear of containment structure 102 by the rotation of imaging member 12, while the balance of the vapor forming the overspray 106 is contained within containment structure 102. A fan 108 or similar apparatus operates to extract overspray 106 from within containments structure 102. The dampening fluid may thereafter be extracted from the mixture of air and overspray through filtering, attraction of droplets to a charged surface 110, or by other mechanism known in the art, and collected in a reservoir 112.

Figure 9:
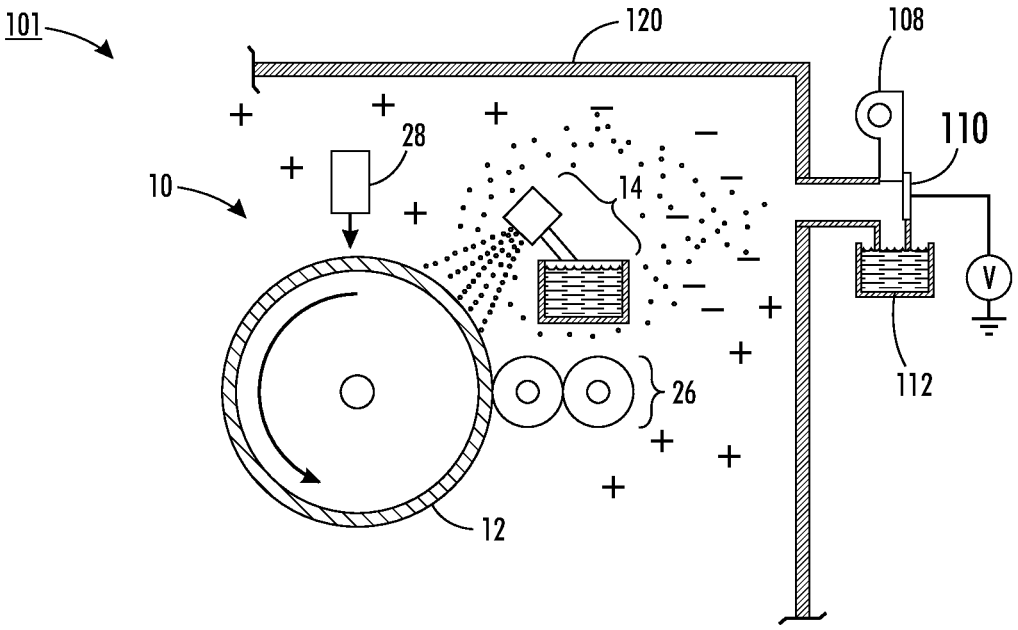
FIG. 9 is a cross-sectional view of a second embodiment of a dampening fluid vapor removal subsystem comprising a portion of a non-contact dampening fluid deposition subsystem according to the present disclosure.

Another embodiment 101 for preventing introduction of dampening fluid into the external environment is illustrated in FIG. 9. This embodiment is similar to that shown in FIG. 8, with the difference that in place of a containment structure in which dampening fluid subsystem 14 is housed, a local region of low pressure is formed in housing 120 enclosing the system 10. A fan 108 or similar apparatus may form this local region of low pressure. The dampening fluid may thereafter be extracted from the mixture of air and overspray through filtering, attraction of droplets to a charged surface 110, or by other mechanism known in the art, and collected in a reservoir 112.

Solution-Extrusion Subsystem

Figure 10:
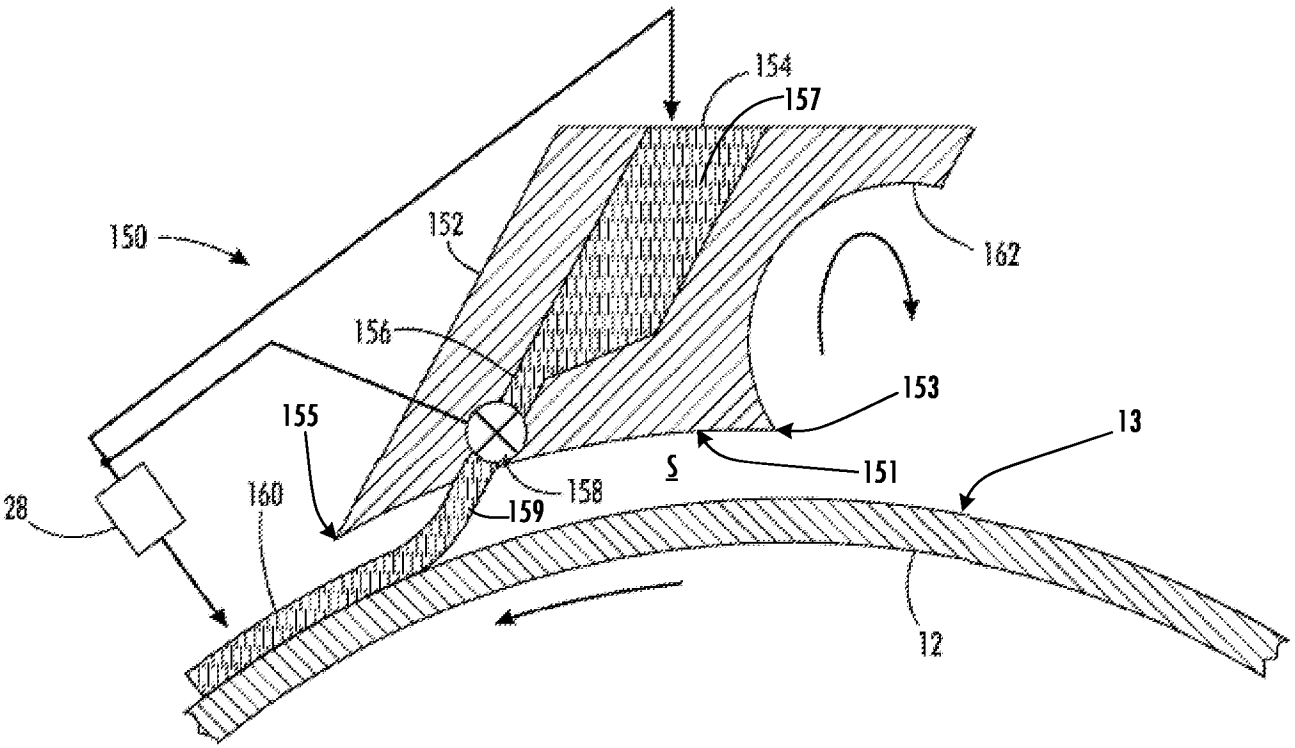
FIG. 10 is a cross-sectional view of a first embodiment of a dampening fluid extrusion subsystem comprising a portion of a non-contact dampening fluid deposition subsystem according to the present disclosure.

With reference to FIG. 10, there is illustrated therein another embodiment 150 for rollerless, direct application of dampening fluid to a reimageable surface 13 in the context of a variable data digital lithography system. Embodiment 150 comprises a liquid ribbon extruder 152 having a lower surface 151 extending between a leading edge 153 and a trailing edge 155 and shaped and disposed to be proximate to reimageable surface 13 of rotating imaging member (plate cylinder) 12. Extruder 152 supplies dampening fluid 157 from a reservoir 154 through a port 156 that extends in the cross-process direction along lower surface 151 substantially the full width of the reimageable surface. Dampening fluid 157 is thereby essentially extruded as a continuous fluid ribbon (sheet) 159 that is directly applied to reimageable surface 13. With proper control of extrusion rate, such as by way of valve 158, back pressure on reservoir 154, dimension of port 156, viscosity of the dampening fluid, and so on, ribbon 159 of dampening fluid may be caused to exit port 156 at substantially the same velocity as the circumferential speed of reimageable surface layer 13 of rotating imaging member 12. In one embodiment, ribbon 159 of dampening fluid forms a layer 160 approximately 1-2 microns thick across the surface of reimageable surface 13 of rotating imaging member 12.

In the present case of depositing a relatively thin fluid layer over a rotating surface, surface effects must be considered in order to ensure uniform application of the dampening fluid over the reimageable surface. For various physical reasons, as imaging member 12 rotates, a layer of entrained air (or other ambient fluid) is formed at its surface. This entrained air layer may underlay a fluid layer deposited over the reimageable surface unless the entrained air layer is interrupted. To this aim, extruder 152 may be shaped or have attached thereto or associated therewith a structure for disrupting or evacuating the entrained air layer, wherein said structure is disposed adjacent leading edge 153 and above lower wall 151. According to one embodiment, a semi-cylindrical vortex generating wall 162 is formed in extruder 152. Semi-cylindrical vortex generating wall 162 is located directly above leading edge 153 and extends along the entire width of extruder 152. Semi-cylindrical vortex generating wall 162 is configured such that, as imaging member 12 rotates, at least a portion of the boundary layer entrained air that is disposed above reimageable surface 13 and located adjacent leading edge 153 is directed into vortex generating wall 162. This produces a vortex, resulting in a slight negative pressure in the space S defined between valve 158 and plate cylinder 12 (i.e., between lower surface 151 and reimageable surface 13). This negative pressure extracts the entrained air boundary layer from space S and draws dampening fluid ribbon (sheet) 159 into surface contact with reimageable surface 13 of imaging member 12, resulting in more uniform coverage of the dampening fluid layer 160 over reimageable surface 13.

Vapor Chamber Deposition Subsystem

Figure 11:
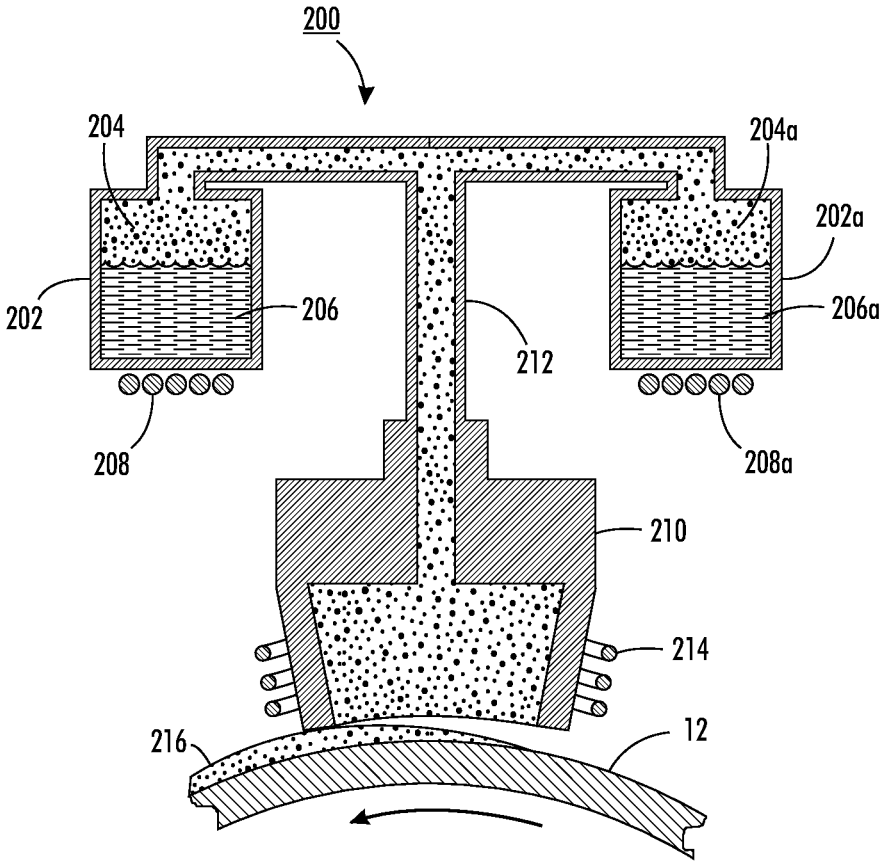
FIG. 11 is a cross-sectional view of a first embodiment of a vapor chamber-based subsystem comprising a portion of a non-contact dampening fluid deposition subsystem according to the present disclosure.

With reference next to FIG. 11, there is shown therein yet another embodiment 200 for no-roller application of dampening fluid to a reimageable surface in the context of a variable data digital lithography system. Embodiment 200 comprises a vaporization chamber 202 that creates a vapor 204 of dampening fluid from a reservoir of such solution 206. A boiler 208 or similar apparatus may heat the solution in reservoir 206 to accomplish vaporization in a pressurized environment (other pressure and/or temperature mechanisms may similarly be employed). Such an embodiment may be used in cases of a single component dampening fluid, such as perfluorinated ethers. If the dampening fluid consists of more than one component, and if the various components have different boiling points, then multiple vaporization chambers and boilers (e.g., 202*a*) with different temperatures, one for each volatile component, can be used in parallel.

The dampening fluid vapor 204 is transmitted to a heated condensation chamber 210, by way of a heated or heat-conductive conduit 212. The surfaces of condensation chamber 210 may be heated by thermal conduction via conduit 212, or independently heated such as by a heating coil 214. By heating the surface of heated condensation chamber 210 a temperature differential is created between the interior of condensation chamber 210 and the relatively cooler reimageable surface of imaging member 12. If the ambient within condensation chamber 210 is well below the boiling point of the vapor, the vapor condenses in the ambient and forms droplets before coming into contact with the reimageable surface of the imaging member 12. If the interior surfaces of the vapor chamber are heated to near or above the boiling point then condensation occurs only, and preferably, on the reimageable surface.

In addition, in the case in which the heat flows between the vaporization chamber 202 and the condensation chamber 210, the heat flow into the vaporization chamber 202 determines the evaporation rate and thus the vapor flow rate. The flow rate of vapor 204 is set to equal the steady state condensation rate on the reimageable surface of imaging member 12 as that surface passes by the condensation chamber 210. The condensation rate is set to provide the desired thickness of a thus-formed dampening fluid layer 216.

When the vapor condenses on the reimageable surface, latent heat is produced. For low latent heat dampening fluids, the latent heat will typically be negligible. However, heating a portion of the reimageable surface of imaging member 12 proximate condensation chamber 210, such as by its proximity to heating coil 214 or by other mechanisms, before patterning by optical patterning subsystem 16 can provide a small assist by reducing the optical power needed for patterning. Furthermore, heating the reimageable surface before inking at inking subsystem 18 can assist with obtaining a desired rheology change between inking and transfer.

Blade Metering Subsystem

Figure 12:
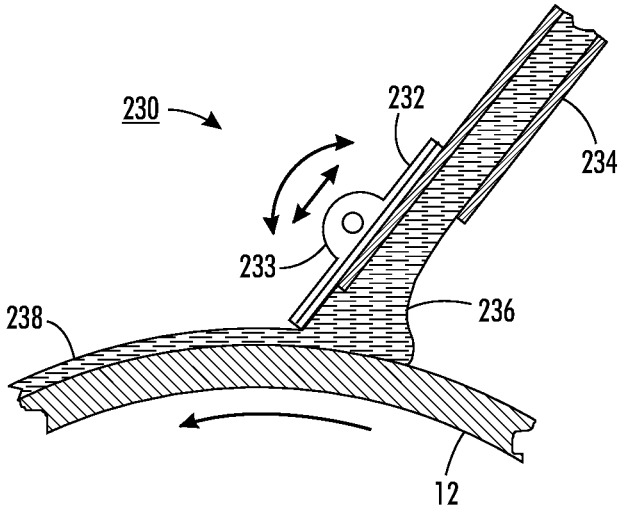
FIG. 12 is a cross-sectional view of a first embodiment of a blade metering subsystem comprising a portion of a non-contact dampening fluid deposition subsystem according to the present disclosure.

With reference next to FIG. 12, there is shown therein yet another embodiment 230 for rollerless, direct application of dampening fluid to a reimageable surface in the context of a variable data digital lithography system. Embodiment 230 comprises blade 232 suspended at a desired distance above the reimageable surface of imaging member 12. Blade 232 may be a soft deformable material consisting of a variety of materials with a variety of durometers and a variety of thickness values. Potential materials include (but are not limited to) silicone, rubber, vinyl, neoprene, Teflon, etc. Moreover, a stiffer material such as a springy metal foil may back blade 232. In general, blade 232 may consist of several layers of different materials to adjust the flexibility and the surface properties of blade 232. Blade 232 may also be coated with material such as Parylene or Teflon to prevent adhesion of materials such as ink, dust particles, etc. Blade 232 may also be electrically conductive to dissipate charge.

A dampening fluid source 234, such as a pressurized nozzle ejector, deposits dampening fluid in a region upstream (behind) blade 232 in the direction of rotation of imaging member 12 to form an accumulation 236 of dampening fluid. The rate of application of the dampening fluid is adjusted relative to the rate of rotation of imaging member 12 such that dampening fluid does not over-accumulate. The spacing and angle between blade 232 and the reimageable surface determines the thickness of layer 238 of dampening fluid over the reimageable surface. This spacing and angle may be adjustable by way of an optional mount 233.

Figure 13:
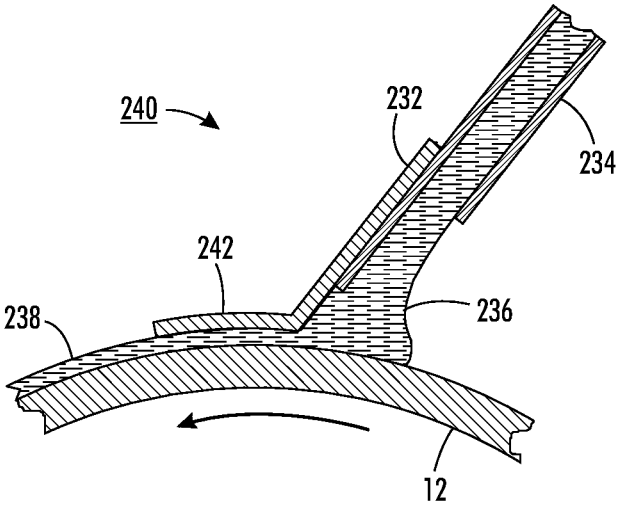
FIG. 13 is a cross-sectional view of a second embodiment of a blade metering subsystem comprising a portion of a non-contact dampening fluid deposition subsystem according to the present disclosure.

Shown in FIG. 13 is another embodiment 240 for rollerless, direct application of dampening fluid to a reimageable surface in the context of a variable data digital lithography system. Embodiment 240 is a variation of embodiment 230 shown in FIG. 12 in that a relatively flexible contour member 242 is secured to (or formed as a part of) blade 232. One benefit of embodiment 240 is that a controlled and in certain embodiments adjustable force can be applied at the location at which dampening fluid layer 238 is formed. This results in a uniform dampening fluid layer thickness and reduced streaking and other artifacts present in known dampening fluid systems. In one example of this embodiment, flexible contour member 242 comprises a rubber wiper attached to a rigid blade 232. In another example, blade 232 and flexible contour member 242 are a monolithic structure, with blade portion 232 having a first thickness rendering it relatively rigid and a contour member portion 242 of a second thickness that is thinner than the first thickness to thereby render the contour member portion 242 relatively more flexible.

Figure 14:
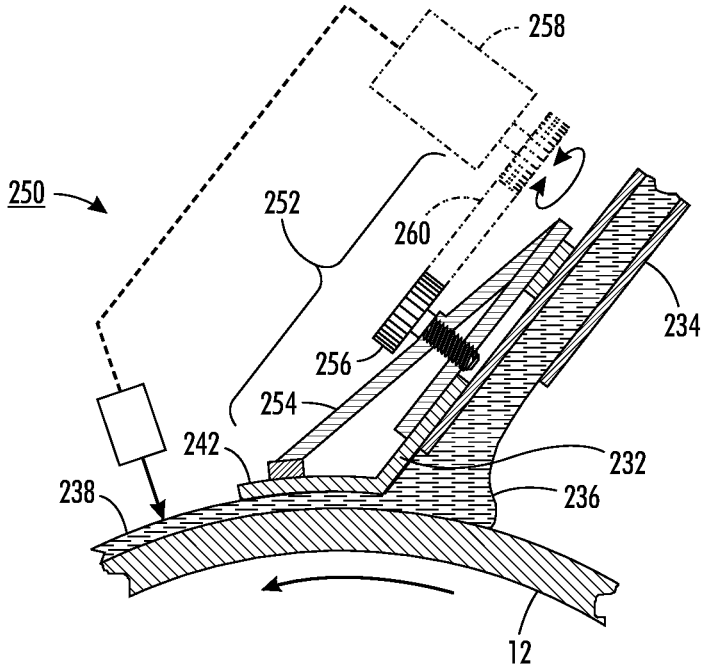
FIG. 14 is a cross-sectional view of a third embodiment of a blade metering subsystem comprising a portion of a non-contact dampening fluid deposition subsystem according to the present disclosure.

In another embodiment 250 shown in FIG. 14, a two-part blade/contour member 252 is positioned over the reimageable surface of rotating imaging member 12 so as to meter dampening fluid from accumulation 236 to form layer 238. Two-part blade/contour member 252 comprises a plate 254 and set-screw 256 used to apply pressure, via plate 254, to contour member 242. Set-screw 256 may manually or by way of a servo motor 258 and belt 260 (or similar mechanism) control both the force and physical position of contour member 242 relative to the reimageable surface, to control the thickness of layer 238. In place of a set-screw and servo, a piezoelectric device may also be used to control the position of and pressure applied by two-part blade/contour member 252.

Figure 15:
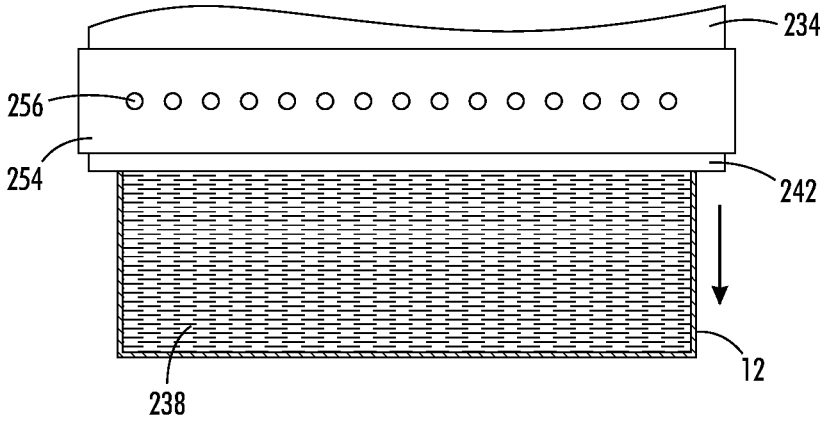
FIG. 15 is a top view of the third embodiment of a blade metering subsystem comprising a portion of a non-contact dampening fluid deposition subsystem according to the present disclosure.

The adjustment provided by two-part blade/contour member 252 may be locally variable, such as illustrated in FIG. 15, to compensate for non-uniformities over the width of the reimageable surface. The adjustments may be varied during use to maintain a desired dampening fluid layer thickness. A control subsystem incorporating thickness sensor subsystem 28 may accomplish this dampening fluid deposition control.

Figure 16:
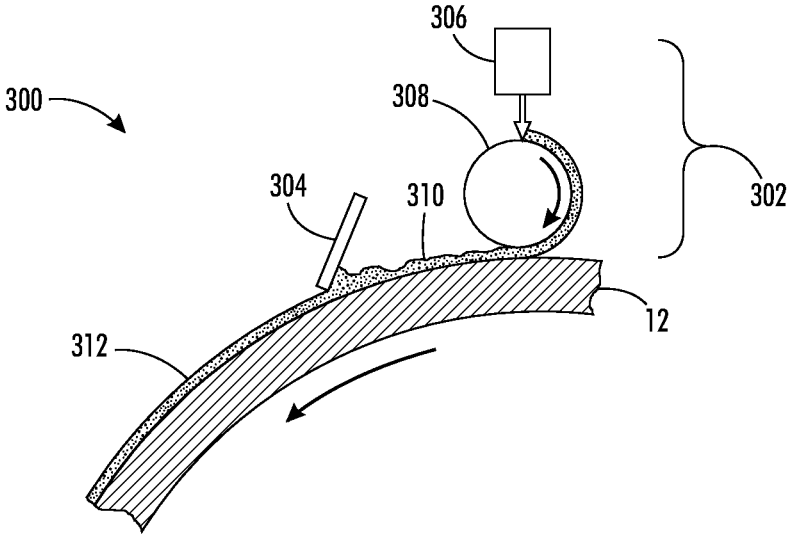
FIG. 16 is a side view of another embodiment of a blade metering subsystem comprising a portion of a non-contact dampening fluid deposition subsystem with dampening fluid roller dispenser according to the present disclosure.

In another embodiment 300 shown in FIG. 16, a dampening fluid dispenser subsystem 302 is positioned immediately behind and proximate blade 304. Dispenser subsystem 302 comprises a dampening fluid reservoir 306 and an applicator 308, such as a sponge roller, rubber roller etc. A layer 310 of dampening fluid is applied over the surface of rotating imaging member 12 by applicator 308, which may present undesirable variations in thickness. Blade 304 is maintained at a relatively uniform height over the surface of rotating imaging member 12 so as to meter dampening fluid to form layer 312 of relatively uniform thickness over rotating imaging member 12.

Figure 17:
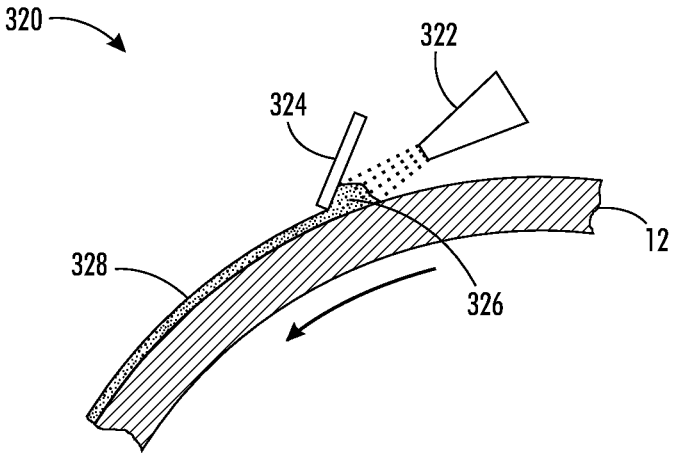
FIG. 17 is a side view of yet another embodiment of a blade metering subsystem comprising a portion of a non-contact dampening fluid deposition subsystem with dampening fluid spray dispenser according to the present disclosure.

With reference to FIG. 17, another embodiment 320 providing application and metering of dampening fluid is shown. According to this embodiment, a spray applicator 322 applies a layer dampening fluid 326 to the surface of rotating imaging member 12. Again, layer 326 may present undesirable variations in thickness. Blade 324 is maintained at a relatively uniform height over the surface of rotating imaging member 12 so as to meter dampening fluid to form layer 326 of relatively uniform thickness over rotating imaging member 12

A number of different configurations for the tip of the aforementioned blade embodiments are contemplated herein. (While the term "tip" is used in the following, it will be appreciated that due to the blade extending into the page as illustrated in the following-described figures the tip is actually en edge of the blade.) The tip configuration will have a direct impact on the quality of the resulting metered layer of dampening fluid. For example, reduced "streaking" in the dampening fluid layer (and hence in the final image) may be achieved. In one embodiment, smoothness of the tip is an object. In others, a desired surface texture in the object.

Figure 18:
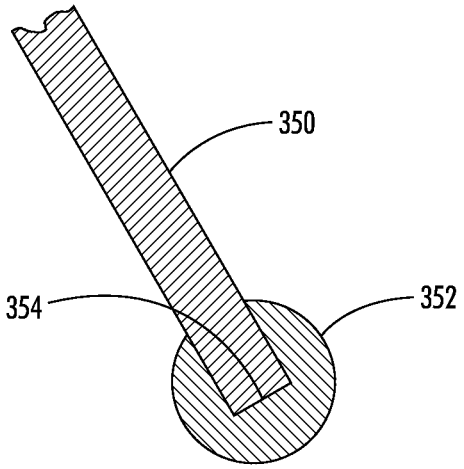
FIG. 18 is a side view of a portion of an embodiment of a metering blade having a bead tip for a blade metering subsystem according to the present disclosure.

With reference to FIG. 18, blade 350 useful in any of the metering embodiments described herein may be provided with a polymer bead 352 applied to the tip thereof. Bead 352 may be applied by any of a variety of methods, such as dipping the tip 354 of blade 350 into a liquid polymer, such as uncured silicone. After curing the silicone, a smooth blade tip (edge) is formed.

Figure 19:
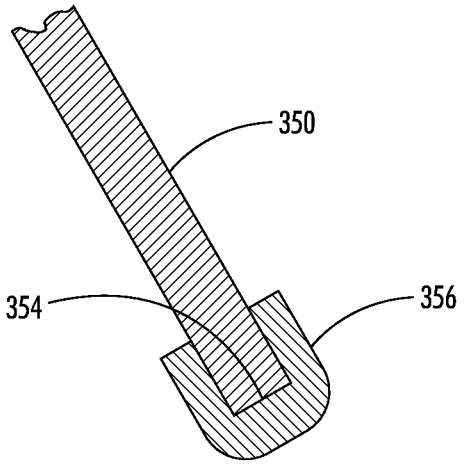
FIG. 19 is a side view of a portion of another embodiment of a metering blade having a wrapped tip for a blade metering subsystem according to the present disclosure.

With reference to FIG. 19, blade 350 may alternatively be provided with a foil covering 356 at its tip 354. Foil 356 may, for example, be a thin polyimide, Mylar foil or tape, etc. Foil 356 may be manually applied, applied by a dedicated or general-purpose machine, and so on. Plating, vapor depositing, or other technique of depositing a relatively smooth, uniformly thick metal or metal composite layer may also obtain a similar result.

Figure 20:
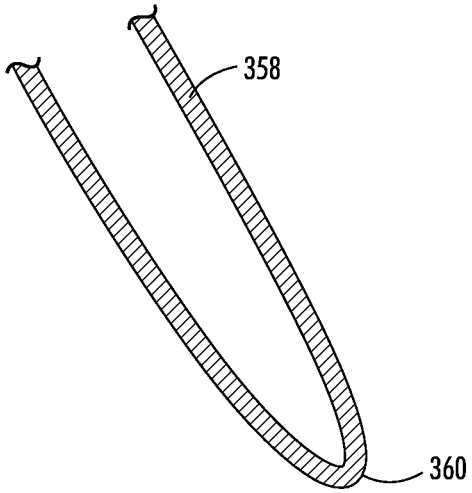
FIG. 20 is a side view of a portion of yet another embodiment of a metering blade having a folded geometry for a blade metering subsystem according to the present disclosure.

With reference to FIG. 20, a blade 358 useful in any of the metering embodiments described herein may be constructed by folding a foil, thin polymer sheet (such as a relatively thin rubber or silicone sheet), or the like. The folding process is such that a uniform, smooth tip 360 is produced.

Figure 21:
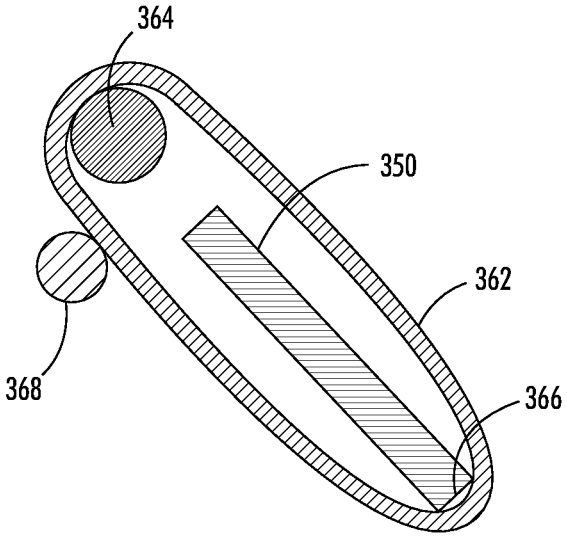
FIG. 21 is a side view of a portion of still another embodiment of a metering blade having a belt tip for a blade metering subsystem according to the present disclosure.

With reference to FIG. 21, blade 350 is disposed within a belt, loop or the like 362. Belt 362 may be, for example, a thin (e.g., approx. 1 mil) Mylar foil. A drive wheel 354 rotates, causing a rotation of belt 362 past the tip (edge) 366 of blade 350. As belt 362 rotates, it passes by a cleaning subsystem 368, which removes marking material and other particle contamination therefrom. In this embodiment, belt 362 may optionally be a consumable item within a marking system to improve longevity of the system and quality of the images produced thereby.

In various of the above-described embodiments it may be desirable to supplement the dampening fluid deposition mechanisms with a blading metering system to further control the uniformity of the thin layer of dampening fluid applied over the reimageable surface of imaging member 12. Therefore, the blade metering system described above may be combined with other dampening fluid application embodiments described herein and operated in tandem.

No limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "as nearly as practicable", "within technical limitations", and the like.

Furthermore, while a plurality of preferred exemplary embodiments have been presented in the foregoing detailed description, it should be understood that a vast number of variations exist, and these preferred exemplary embodiments are merely representative examples, and are not intended to limit the scope, applicability or configuration of the disclosure in any way. Various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described embodiments may be made without departing from the spirit and scope of the disclosure defined by the claims thereto.

What is claimed is:

1. A system for applying a dampening fluid to a reimageable surface of an imaging member in a variable data lithography system, comprising:

a body structure having a lower surface facing the reimageable surface between a leading edge and a trailing edge such that a space is defined between the lower surface and the reimageable surface, the lower surface having formed therein a port, said port extending in a first direction substantially perpendicular to a direction of travel of said reimageable surface when in use, said port having a width at least equal to a width of said reimageable surface in said first direction, said port configured to deliver dampening fluid in a continuous fluid sheet directly to said reimageable surface such that said continuous fluid sheet has a sheet width substantially equal to the width of said reimageable surface to thereby form a dampening fluid layer thereover;

a vortex generating structure disposed on said body structure adjacent to said leading edge and above the lower surface, wherein said vortex generating structure is configured to strip at least a portion of an entrained air layer that is disposed over said reimageable surface and located adjacent leading edge when said reimageable surface is in motion, whereby a slight negative pressure is produced in the space defined between the lower surface and said reimageable surface that draws said fluid sheet into surface contact with said reimageable surface;

a dampening fluid reservoir disposed to provide dampening fluid to said port; and a control mechanism for controlling the flow of dampening fluid from said reservoir to said port and from said port to said reimageable surface.

2. The system of claim 1, wherein said vortex generating structure is formed in said body structure.

3. The system of claim 2, wherein said is vortex generating structure comprises a semi-cylindrical recess formed in said body structure, said semi-cylindrical recess shaped and disposed to form a vortex from said entrained air layer over said reimageable surface when said reimageable surface is in motion proximate said body structure.

4. The system of claim 1 wherein said control mechanism comprises a valve capable of adjustably regulating the flow of dampening fluid therethrough.

5. The system of claim 4, further comprising a thickness sensor control subsystem communicatively coupled to and controlling said valve for determining a thickness of said dampening fluid layer and from said determined thickness controlling said valve to obtain a dampening fluid layer of a desired thickness.

6. The system of claim 1, further comprising a blade metering system to be disposed proximate but spaced apart from said body structure to control the thickness of said dampening fluid layer.

7. The system of claim 6, further comprising an adjustment mechanism for adjusting the pressure applied by said blade metering system against dampening fluid passing thereunder, and further adjusting spacing between said blade metering system and said reimageable surface, so as to provide control of the thickness of said dampening fluid.

8. The system of claim 7, further comprising a thickness sensor control subsystem communicatively coupled to and controlling said adjustment mechanism for determining a thickness of said dampening fluid layer and from said determined thickness controlling said adjustment mechanism to obtain a dampening fluid layer of a desired thickness.

9. The system of claim 6, wherein said blade metering system comprises a blade member having a proximal edge disposed proximate said reimageable surface, said proximal edge further comprising an applied edge covering substantially alone its lateral extent.

10. The system of claim 9, wherein said applied edge is comprised of a material selected from the group consisting of: polymer, metal, and composite material.

11. The system of claim 6, wherein said blade metering system comprises a blade member formed of a folded sheet material.

12. The system of claim 11, wherein said blade member is formed of a material selected form the group consisting of: polyimide, metal, and composite material.

* * * * *